US008292106B2

(12) United States Patent
Humberto

(10) Patent No.: US 8,292,106 B2
(45) Date of Patent: Oct. 23, 2012

(54) MOUNTABLE AND DEMOUNTABLE STACKABLE CONTAINER HAVING VERTICAL PLASTIC WALLS AND STIFF FLAT BOTTOM

(76) Inventor: Orozco Gavaldon Humberto, Santa Isabel Iztapalapa (MX)

( * ) Notice: Subject to any disclaimer, the term of this patent is extended or adjusted under 35 U.S.C. 154(b) by 93 days.

(21) Appl. No.: 12/803,772

(22) Filed: Jul. 6, 2010

(65) Prior Publication Data

US 2011/0248031 A1 Oct. 13, 2011

(30) Foreign Application Priority Data

Apr. 8, 2010 (MX) ..... MX/A/2010/003782

(51) Int. Cl.
*B65D 6/00* (2006.01)
*B65D 8/14* (2006.01)

(52) U.S. Cl. ..... 220/4.29; 220/6

(58) Field of Classification Search ..... 220/4.28, 220/4.29, 6, 7; 206/600
See application file for complete search history.

(56) References Cited

U.S. PATENT DOCUMENTS

| | | | | |
|---|---|---|---|---|
| 3,618,275 | A * | 11/1971 | Ance | 52/169.1 |
| 4,960,223 | A | 10/1990 | Chiang | |
| 5,458,255 | A * | 10/1995 | Addeo et al. | 220/6 |
| 5,855,291 | A | 1/1999 | Ingle | |
| 6,019,226 | A | 2/2000 | Zajdlik | |
| 2011/0180533 | A1 * | 7/2011 | Hay et al. | 220/4.28 |

* cited by examiner

*Primary Examiner* — Harry Grosso
(74) *Attorney, Agent, or Firm* — Carmen Pili Ekstrom

(57) ABSTRACT

Mountable and demountable stackable container having vertical plastic walls and stiff flat bottom, for complementing closets, cupboards, bookshelves, selves, pieces of furniture, storage areas, and other office areas or even directly on the floor, comprising two flat plastic modules having folds as hinges to form a container, the ends of said modules being secured by clamp elements and a stiff flat bottom base, made of wood, for example, that is accommodated in the guide groove located in the plastic modules and that can be secured to said base through tab projections having injected lugs.

19 Claims, 11 Drawing Sheets

FIG.3
FIG.3A
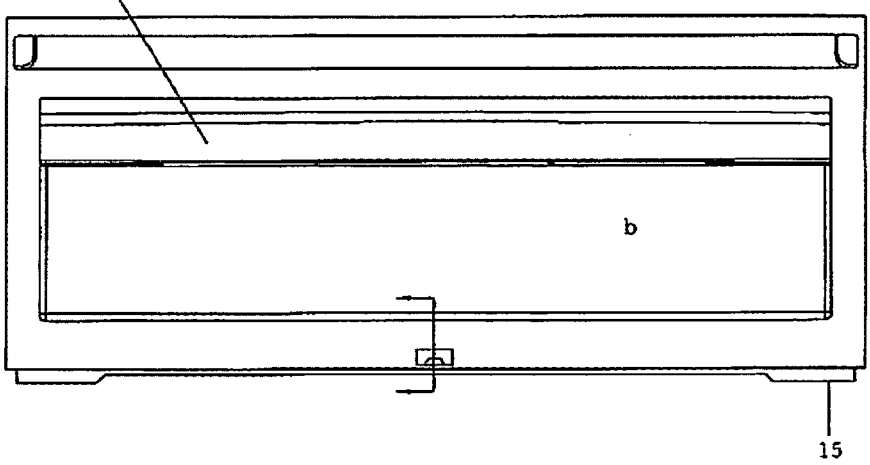
FIG.3B
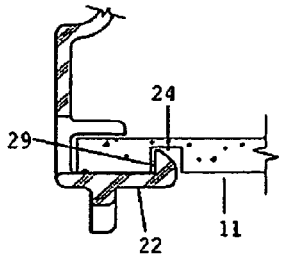

a
f
e
13
13'
13''
13''
12
12
21
22
22
29
29
28
16''
30
14
17
31

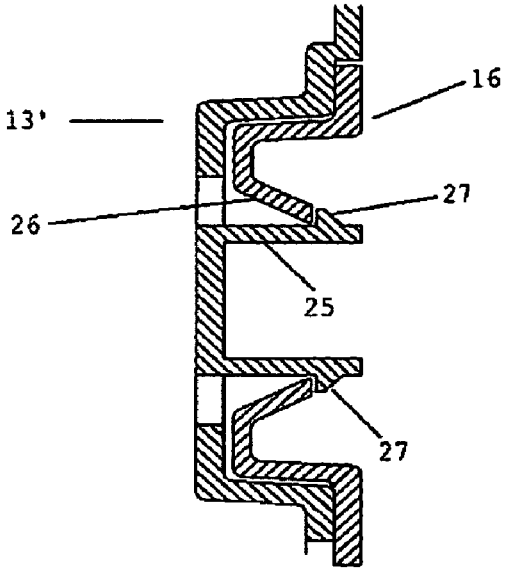
FIG.7
FIG.7A
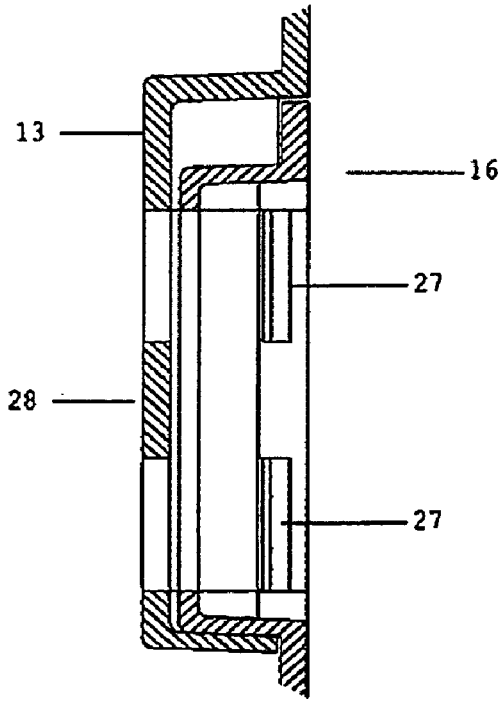
FIG.7B

FIG. 10
FIG.10A
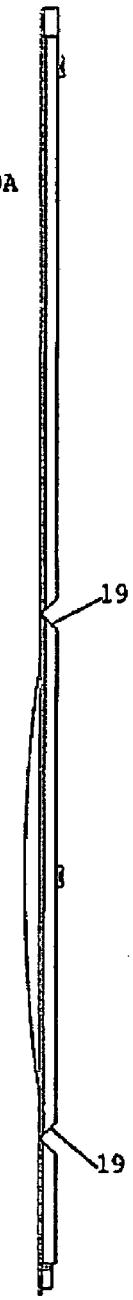
FIG.10B
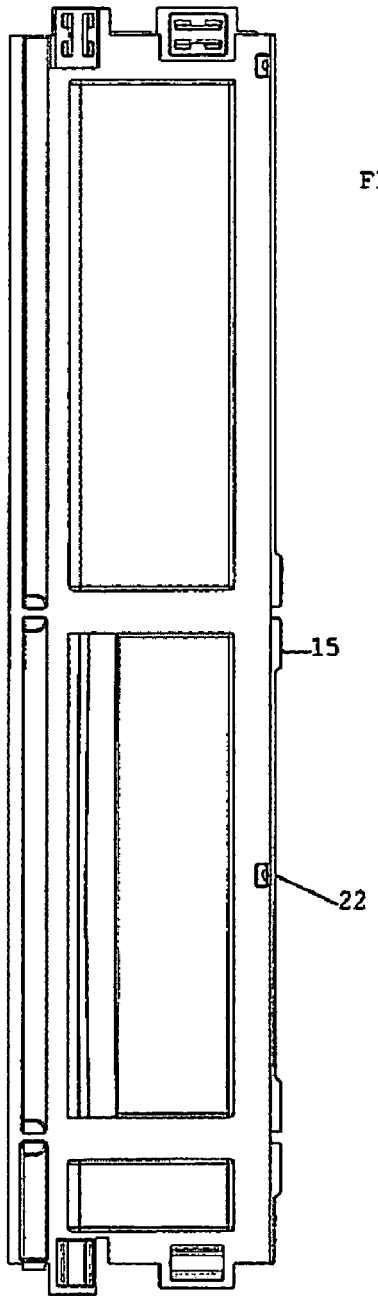
FIG.10C
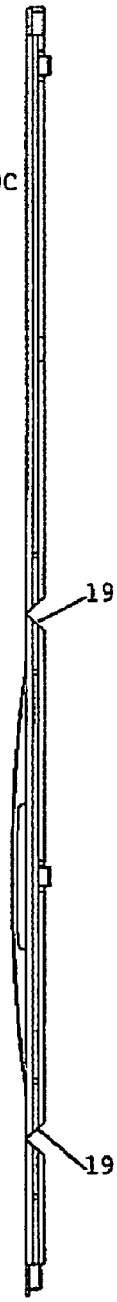

FIG.11
FIG.11A
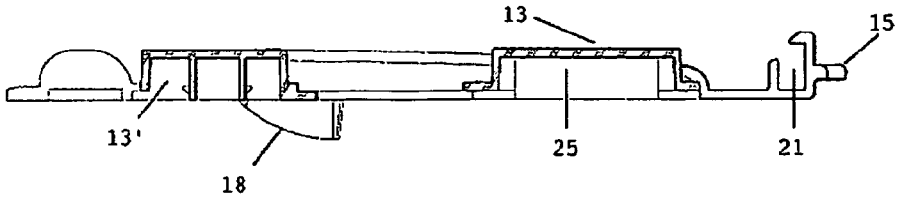
FIG.11B
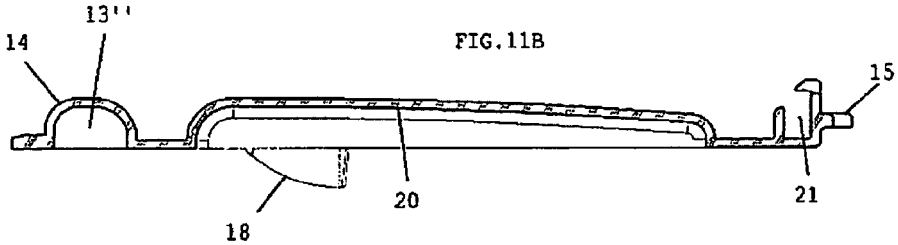
FIG.11C
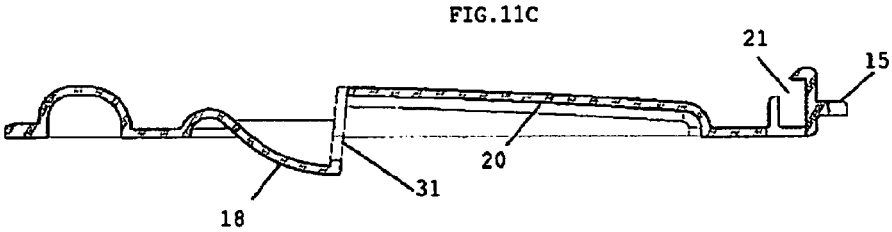

MOUNTABLE AND DEMOUNTABLE STACKABLE CONTAINER HAVING VERTICAL PLASTIC WALLS AND STIFF FLAT BOTTOM

BACKGROUND OF THE INVENTION

1. Field of the Invention

The invention relates to a stackable container having vertical plastic walls and stiff flat bottom, made of wood or board, for example that is moreover mountable and demountable. It is assembled using two identical injected plastic modules and a flat stiff bottom held together through clamps and hinges injected in the same mold and pressure fitted by the user forming the stiff and demountable container with reinforcing contour edges.

2. Description of the Prior Art

Several techniques are known to manufacture containers, especially wooden drawers for closets or pieces of furniture, such as for example U.S. Pat. No. 4,960,223, that describes a "box crate" container comprising a base plate, two handle plates and two side plates, wherein said plates pivot inwardly to collapse to the container by means of two release bars that are respectively located within two "T" shaped grooves of the plates. As can be seen, this invention relates to the assembly of four side plates and one base plate and is thus more fragile when it collapses.

U.S. Pat. No. 5,855,291 describes a "Vehicle Cargo Restrainer" provided with a device to protect or secure articles and parcels within said restrainer that comprises an open rectangle to facilitate storage that is collapsible into a nearly flat configuration and comprises two handles for carrying it to a different place. Said restrainer can be used to fix or secure the articles carried in moving vehicles.

Spanish patent U 200301105 describes an independent sliding closet drawer characterized because it comprises in one piece the back and side walls of the drawer from 90° bevels on the plate that are folded at right angles to be joined with the front one through pins and blind holes with the positioning of the bottom part through grooves on the plate and the front part and placing moreover a crystal or plastic cover in the front.

U.S. Pat. No. 6,019,226 describes a multi-component demountable palletized container comprising a pallet bottom, four wall components that can be easily assembled and disassembled with rods and a top, each wall includes a pair of horizontal and vertical members that are overlapped at their ends and secured together, each wall and bottom being covered with a board. The vertical members define channels that receive assembly straps or clips having hooked ends that align to define a corner axis receiving the rods. The assembly of this container is mainly through rods at the corners to form the container.

The object of the instant invention is to provide a mixed container having plastic walls and a flat stiff bottom or base, made of wood, for example, wherein said walls are two identical flat modules assembled through pressure clamps and secured to the base through positioning guides and pressure securing elements.

The container is stackable and integrated by injected modules assembled onto a stiff base substrate and can be assembled without tools by the user and is designed for use in available spaces such as in closets, cupboards, shelves, bookshelves, pieces of furniture, storage areas, other office spaces or even directly on the floor because it is stackable.

DESCRIPTION OF THE INVENTION

Hereinafter the invention is described with regard to the drawings of FIGS. 1 to 11, wherein.

FIG. 3 is a front side view of the container with cross section of the pressure securing assembly of the bottom of the container. FIG. 3A is a front side view of the assembled container. FIG. 3B is a cross-sectional view of the secured assembly fanned by the container's stiff bottom panel and one of its plastic modules.

Figure 4:
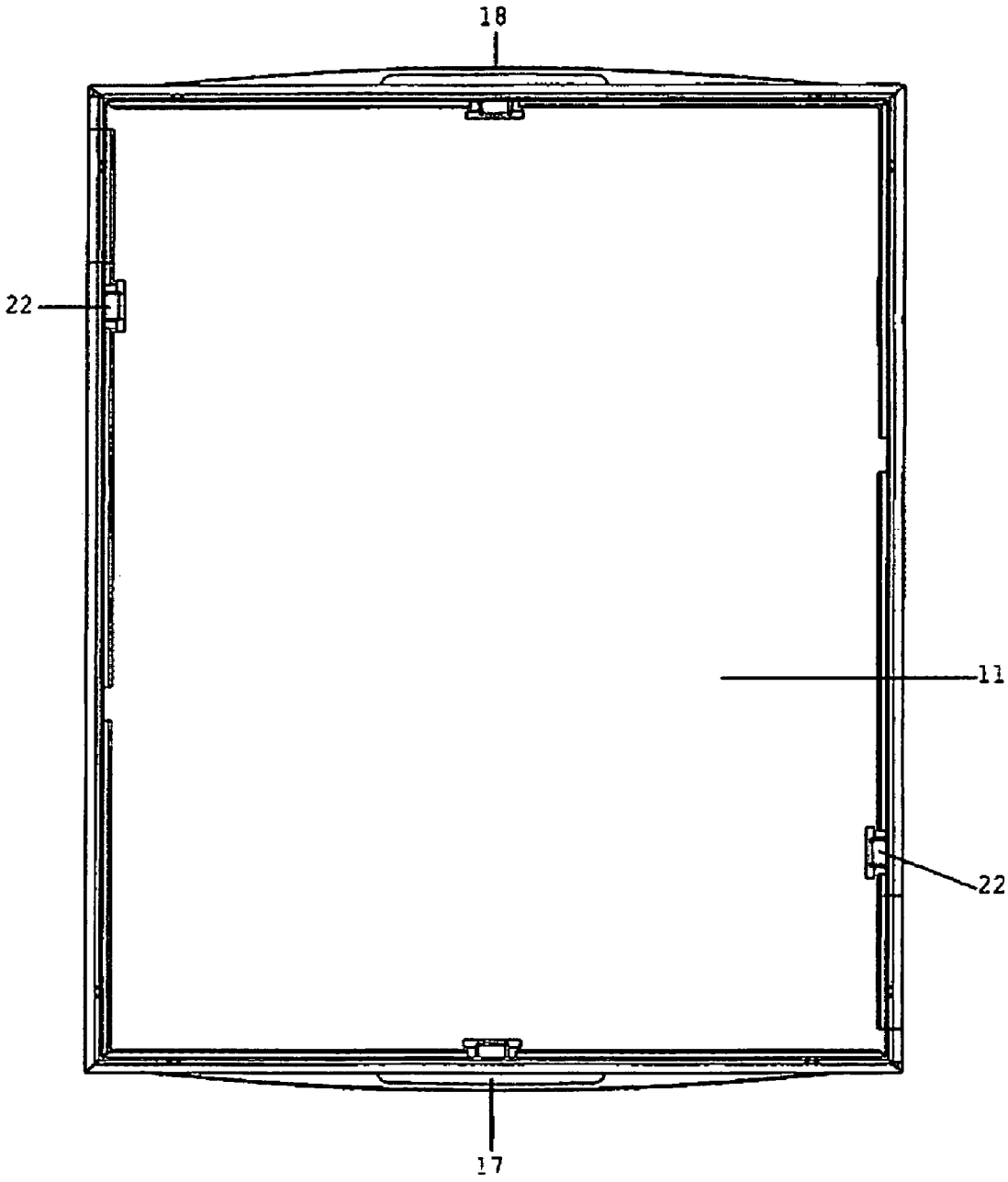

FIG. 4 is a bottom view of the assembled container, through its lower part.

Figure 5:
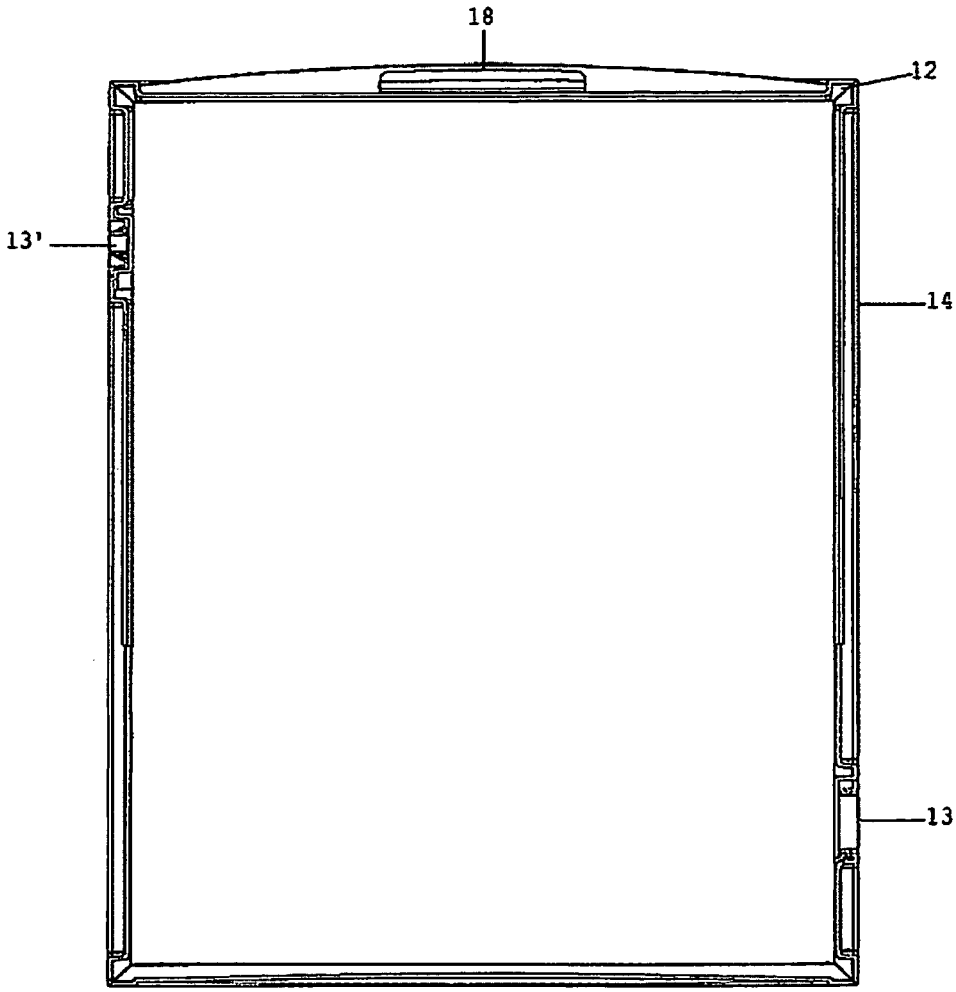

FIG. 5 is an upper plant view of the assembled container.

Figures 6, 6A, 6B, 6C, 6D:
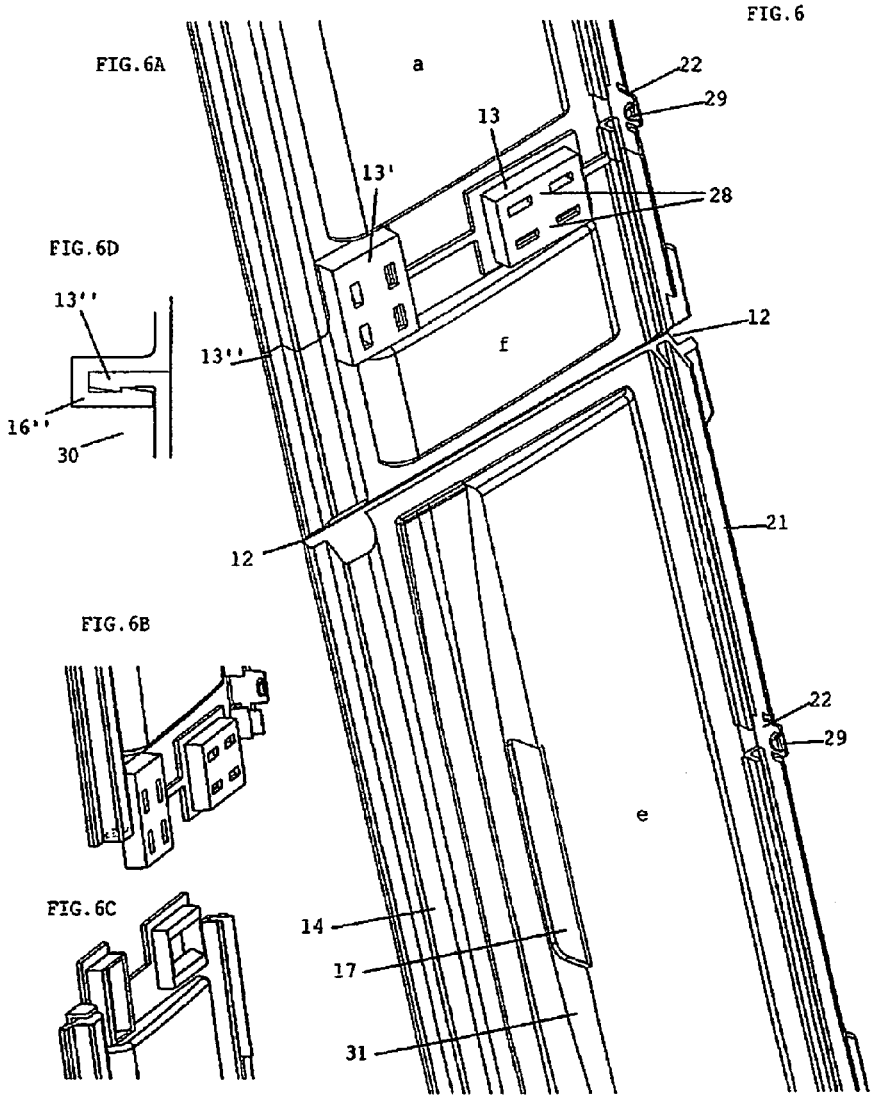

FIG. 6 is a perspective detailed view of the assembled horizontal and vertical clamps, securing elements of the bottom and details of the upper clamp. FIG. 6A is a perspective partial view that shows how the container plastic modules look. on the inside of the container wall, once they are interlocked. FIG. 6B is a perspective partial view of one end of one plastic module showing the interlocking male elements built-in it as they look from inside the container wall. Said view comprises two male interlocking elements located at one same flat reference surface however not parallel oriented in relation to one another, as well as a third plastic module to plastic module alignment element comprising a small wall that is behind the exposed plastic module surface, and its purpose is overlapping with a "U" shaped covering built-in at the opposite end of a plastic module, thus enhancing plastic module joint alignment close to the upper edge of the vertical wall formed by said modules. FIG. 6C is a perspective partial view of the opposite end of a plastic module showing the interlocking elements built-in it as they look from inside the container wall. Said view comprises two female interlocking elements located at one same flat reference surface however not parallel oriented in relation to one another, as well as a third plastic module to plastic module alignment element comprising of a "U" shaped covering that runs orthogonally in relation to said reference surface and is located at the end of the plastic module and close to the upper edge of the module with the purpose of overlapping with the small wall described in FIG. 6B text. FIG. 6D is a cross-sectional view of the overlapped small wall and "U" shaped covering. described in FIG. 6B and FIG. 6C texts when said elements are already overlapped and form an additional alignment feature with a shape of a lug element when two plastic modules are assembled.

FIG. 7 is a cross-sectional view of the securing clamps. FIG. 7A is a cross-sectional view, across the transverse axis, of the male and female interlocking elements, located at each plastic module end, when said elements are already interlocked being the male a built-in part of one plastic module while the female is a built-in part of another plastic module. FIG. 7B is a cross-sectional view, across the longitudinal axis of the set of male-female interlocking and elements already interlocked and forming an interlocking mechanism.

Figure 8:
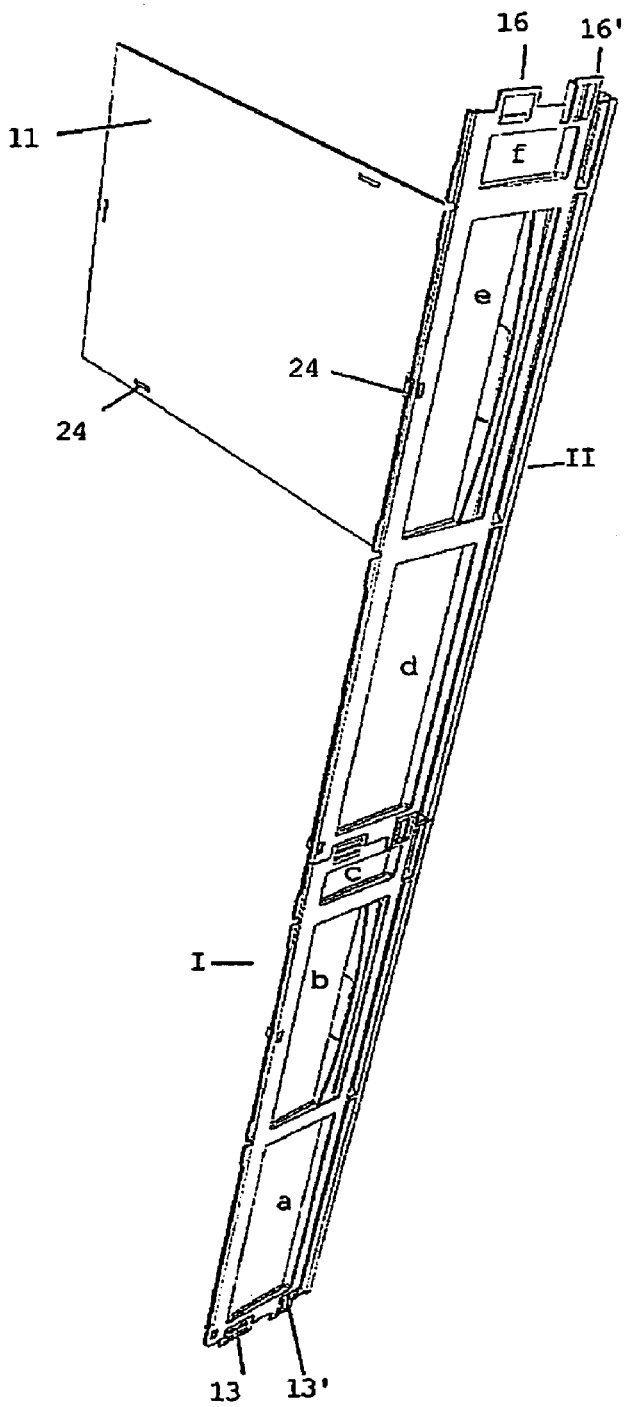

FIG. 8 is a perspective view of the extended modules (I) and (II) with the bottom of the container positioned, seen from the back.

Figure 9:
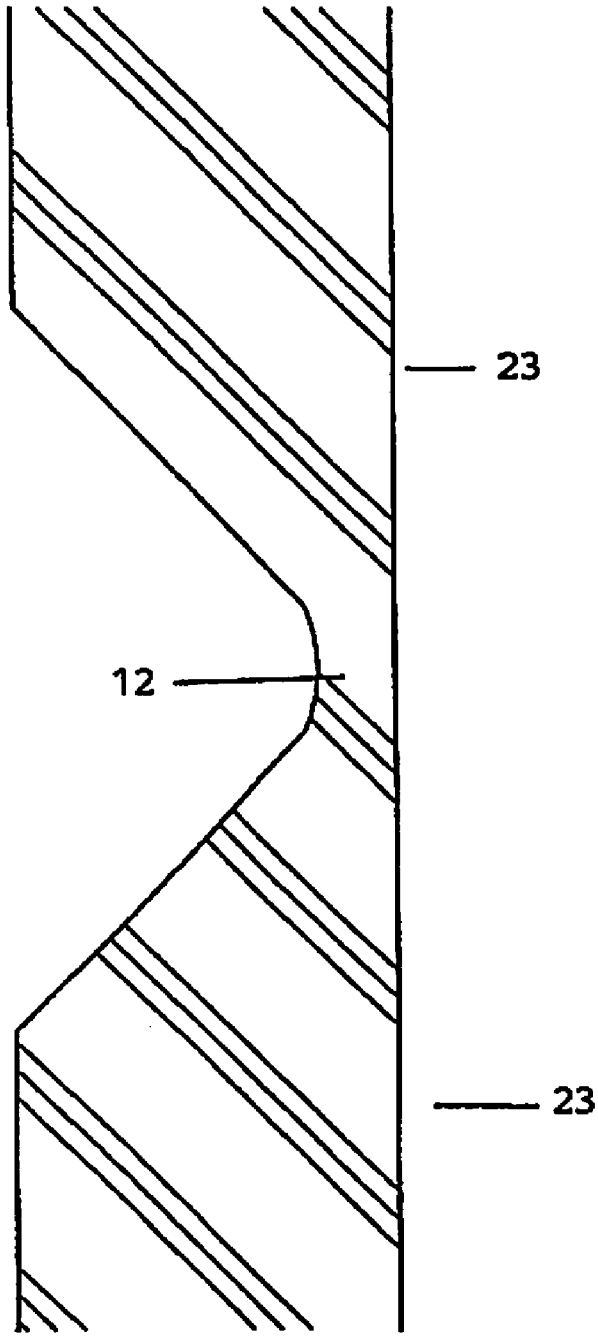

FIG. 9 is a cross section view of a plastic hinge in its extended position.

Figure 2:
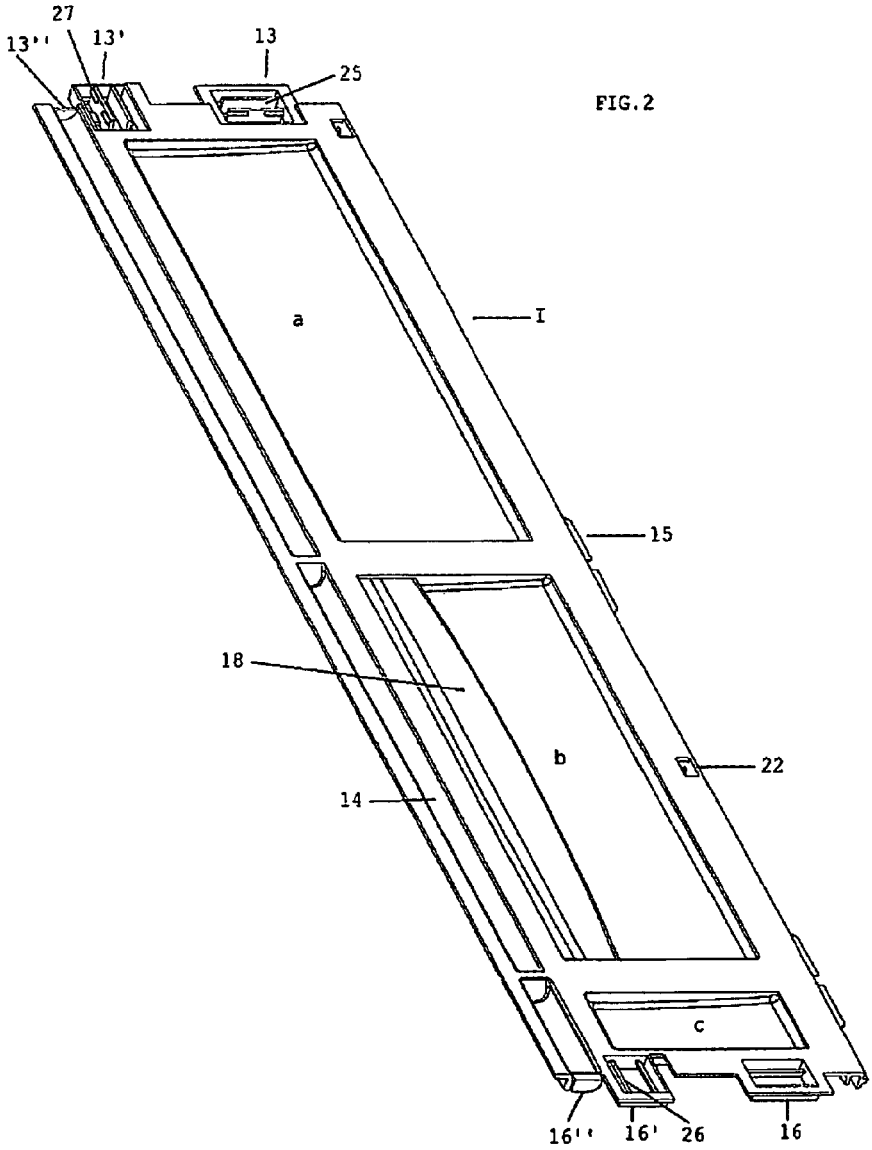
FIG. 2 is an extended view of the container assembly module.

FIG. 10 is a detailed view of FIG. 2, seen in upper and lower plant. FIG. 10A shows one of the container's unassembled and extended plastic modules as seen from the top. FIG. 10B shows the same plastic module as seen from the outside. FIG. 10C shows the same plastic module as seen from the bottom.

FIG. 11 is a cross sectional view of the side and front damps, at the center of the handle. FIG. 11A is a cross-sectional view of a container plastic module cut along a line drawn vertically that runs along the symmetry axis of both built-in interlocking male elements located at one end of said plastic module. FIG. 11B is a cross-sectional view of a container plastic module cut along a line drawn vertically at half the distance between said symmetry axis and the closest plastic hinge built-in the plastic module. FIG. 11C is a cross-sectional view of a container plastic module cut along a line drawn vertically at half the distance between both plastic hinges built-in the plastic module.

Figure 1:
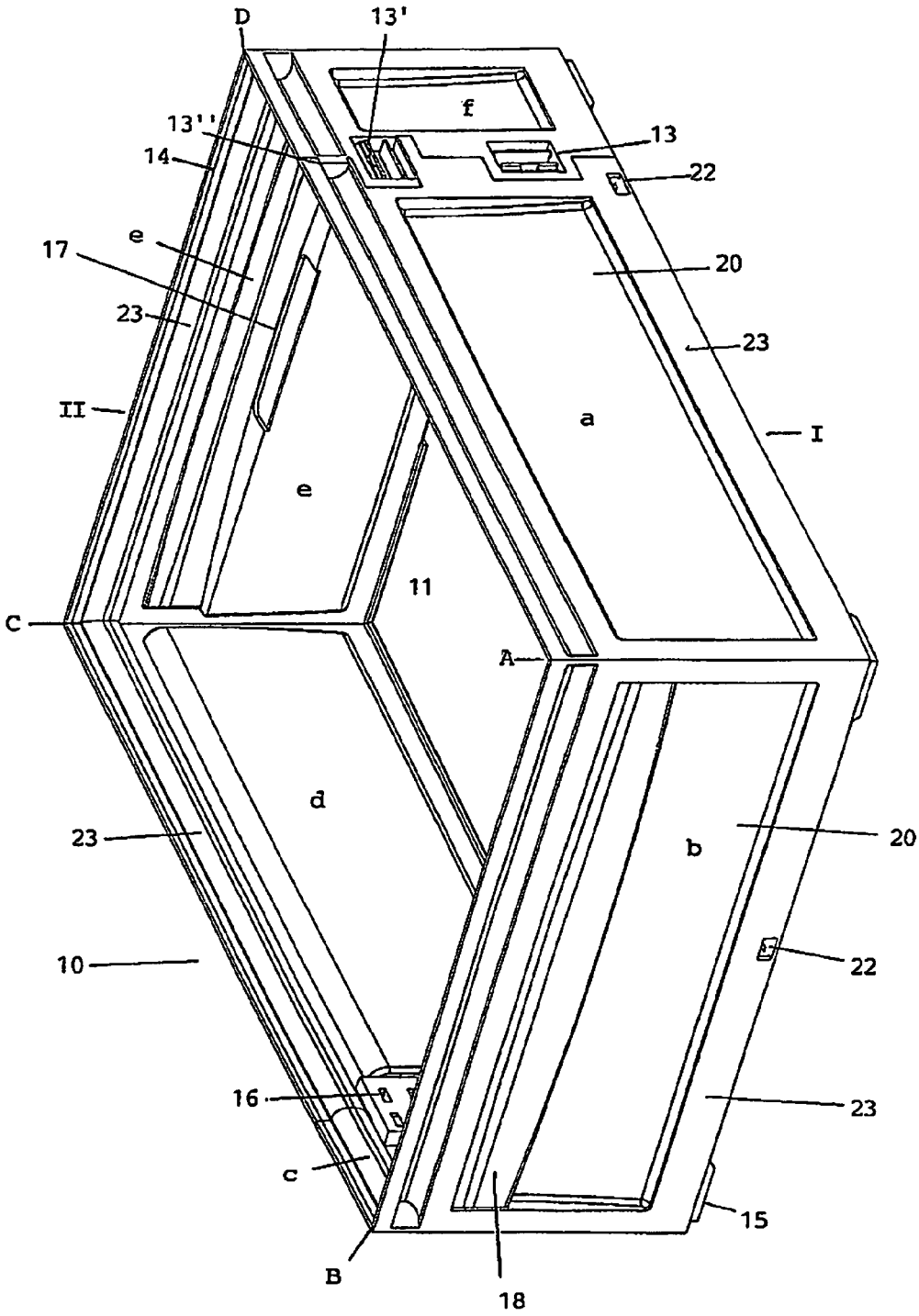
FIG. 1 is a perspective view of the stackable container.

The stackable container 10 FIG. 1 is a container that can be assembled or disassembled by the user, comprising the following assembly parts:

Square or rectangular flat base or bottom element 11 of the container;

Right wall injected flat module I placed at right angle upon being folded;

Left wall injected flat module II placed at right angle upon being folded;

Elements injected in the two modules I and II, clasp 13 and hinge 12, facilitating the assembly.

The container 10 object of the instant invention is characterized wherein it presents two identical injected flat modules I and II (FIGS. 1 and 2) forming the wall sections a, b, c, d, e, f of the container, wherein each module shows respectively two folds, forming a belt having a smaller wall thickness to form a right angle section permitting the creation of the corners A, B, C and D of said container, each module comprises, respectively, at each one of its ends, male clamp elements 13 in FIG. 2, one placed in a vertical position of module I and the other placed in an horizontal position 13' of module I, and upper pressure clamp 13" while at its opposite end, there is a complementary female damp 16, 16', and 16" being said clamps injected as part of the module itself The two modules forming the container are assembled and secured through the clamp mechanism.

In the upper end of the module, on its contour, there is a semi-tubular reinforcing profile element 14, said profile having a larger volume compared to the volume forming the container walls, and offering a greater stiffness presenting moreover said profile in each one of the folds forming the corners A, B, C, and D recessed sections 19, FIG. 10, at a 45° angle. Moreover, the module shows at its lower end a horizontal "U" shape groove 21, FIG. 6, acting as guide element for the assembly of the bottom base 11 of the container.

The guide or groove 21 presents in each module I and II two tab-type injected projections 22, FIG. 6, comprising of a lug 29 acting as a pressure element to secure the bottom base 11 in a groove 24, FIGS. 3 and 8, located in the back part of said bottom without crossing it.

Each module also comprises a belt section of minor thickness acting as injected hinge 12, FIGS. 6, 9, 10, and said hinges are located at each one of the container corners, respectively, permitting the formation of four corners A, B, C, and D upon joining two folded corners of modules I and II and upon forming their corners, they generate a pressure among them increasing thus the contact and stiffness of a wall with the other and generating, a precise consistent assembly. The container walls 23, formed by A, B, C, and D also presents semi-convex areas 20 of low embossing to reinforce the structural stiffness of said container that upon manufacturing it in a flat mold permits to offer the requested texture and decoration finishes.

The container base bottom 11 is a stiff material substrate, preferably, plywood or flat stiff material, for example plywood, wood, plastic material or agglomerated material. The front part of the container base permits that the convex part of the wall 23 cooperates with the upper structure of the wall to form a handle 18, moreover in the opposite side, i.e., the back part, another handle 17 is also formed.

The assembly of the container is performed in the following way:

The two extended modules I and II, FIG. 8, are joined;

The bottom base 11 is inserted in the lower groove 21, FIG. 6, of the wall e) securing it with the tab 22 in the bottom groove 24 FIG. 3 (see FIGS. 8-9);

Walls d) and c) are folded and the side of the bottom is inserted into the groove 21, securing it with the tab 22 in the corresponding groove 24;

Wall b) is folded, securing it in the same way;

Thereafter, wall a) is folded and wall f) is folded till the assembly is complete, the contour of the container being joined both through clamps 13, 13' and 13", FIGS. 1 and 11, as well as through the lower part of the container, with tabs 22 in the bottom grooves 24, FIG. 3.

The clamp 13 is a securing element integrated by two sections, a male-type section in the shape of an injected rectangular box having, in its middle part and along the box a "U" shaped channeled element 25, FIGS. 2 and 7, in the upper end of which a lug 27 is placed to constitute the closure, being the other section a female-type top element 16 having a shape corresponding to the groove 26 FIG. 2 with the "U" channeled element, of the other section, being accommodated to close the clamp through simple manual pressure, 28 (pin).

The upper clamp 13", FIG. 6, is a closing complement of the upper profile of modules I and II though a lug element 30 that accommodates itself through pressure in an inverted "U" shape covering.

In the lower end of each container corner, small fin-type injected projections 15 are placed that connect, for stacking purposes, in stepped openings located on the upper corners A, B, C, and D of the container forming aligned cabinets, either for household purposes or for offices.

Characteristically, the container material must have a folding capability of up to 270° because it has to be bent 180° for packaging purposes and then it has to recover its shape till a 90° position in the opposite sense to form a corner. The indicated sizes are the optimum ones for a household closet but obviously said sizes can be modified for containers having other purposes.

Modules I and II can be translucent, transparent or opaque and of any color and can be manufactured in several combinations together with the bottom colors or materials to adapt to the users taste.

While the invention has been illustrated and described as embodied in a mountable and demountable stackable container, it is not intended to be limited to the details shown, since it is well understood that various omissions, modifications, substitutions and changes in the forms and details of the container illustrated and in its operation can be made by those skilled in the art without departing in any way from the spirit of the present invention.

The invention claimed is:

1. A mountable or demountable stackable container having vertical plastic walls and stiff flat bottom, comprising:

a square or rectangular shaped container having stiff flat bottom base;

a pair of identical modules to form walls adjacent to the stiff flat bottom base comprising a right module and a left module, each module being module I and module II;

each said module is injected in a flat mold having two belt folds to form two 90° right angles;

a plurality of injected elements in each of the two modules for assembly and securing through clamps, or hinges and to engage said modules to the container's stiff bottom base;

wherein module I and module II are rectangular and having said two belt folds in their rectangular section to form two sections at right angles forming four container corners; each module having at one of its ends, injected elements of male clamps wherein one is placed in a vertical position and the other in a horizontal position, and at their opposite ends, a complementary female clamp;

each of said modules having at its upper side, a hollow semi-tubular peripheral profile as a strengthening element of the wall of both modules I and II to increase strength; and the walls of said modules having at their lower side, a horizontal "U" shape groove which serves as a wall guide element permitting to accommodate the container bottom base and to secure it through a plurality of injected tabs protruding on said guide.

2. The mountable or demountable stackable container according to claim 1, wherein each of said modules I and II, further comprises the two belt folds having a smaller folding thickness to act as injected hinge elements to form the corners that, upon being assembled, provides pressure between them to give stiffness to the container.

3. The mountable or demountable stackable container according to claim 1, wherein the horizontal and vertical clamp elements comprise two sections, one section in the shape of a male type injected rectangular box having at its center and along it a "U" shaped channeled element presenting at its upper end, a lug for closing purposes, and the other section being a female type cap element coinciding with the channeled element through a groove to complete the clamp closure through simple pressure.

4. The mountable or demountable stackable container according to claim 1, wherein the semi-tubular peripheral profile further comprises in one of its said belt folds, recessed sections at a 45° angle to form the container corners.

5. The mountable or demountable stackable container according to claim 1, wherein the walls of said modules have semi-convex areas which strengthens the structure stiffness of the container.

6. The mountable or demountable stackable container according to claim 1, wherein the container further comprises at each corner at the bottom, a plurality of small fin type injected projections accommodated in small stepped openings in the upper profile of the modules to allow stacking of the containers.

7. The mountable or demountable stackable container according to claim 1, wherein the container bottom comprises a square or rectangular shape.

8. The mountable or demountable stackable container according to claim 1, wherein the container bottom comprises a stiff material substrate selected from plywood, wood, plastic or agglomerated materials.

9. The mountable or demountable stackable container according to claim 1, wherein the container comprises two handles, one in the front section of the wall of the container and the other in the opposite section; said handles are obtained by defining a convex part of the wall that cooperates with the upper wall structure.

10. The mountable or demountable stackable container according to claim 9, wherein the projection of the handle in the front of the module is accommodated in a cavity of the side part of said module when it is folded at 180° for packaging purposes.

11. The mountable or demountable stackable container according to claim 1, wherein each of the protruding tabs of the wall guide elements is located in each wall guide and having a lug accommodated in a groove located in the lower base of the container bottom.

12. The mountable or demountable stackable container according to claim 1, further comprising an upper clamp element disposed in the upper strengthening profile and is an injected clamp having a lug projection accommodated in an inverted "U" shape covering at the upper side of the module, through simple manual pressure.

13. The mountable or demountable stackable container according to claim 1, wherein the container module walls have a folding capability of up to 270° in order to be bent 180° for packaging purposes and recover its shape until a 90° position in the opposite sense to form a corner.

14. The mountable or demountable stackable container according to claim 1, wherein each of module I or II can be made in various combinations of color, substrate properties, and materials depending on the user.

15. The mountable or demountable stackable container according to claim 14, wherein module I or II may be translucent, transparent or opaque.

16. The mountable or demountable stackable container according to claim 1, wherein the semi-tubular profile have a greater cross sectional shape compared to the cross sectional shape forming the container walls, to provide greater stiffness in each of the said belt folds.

17. The mountable or demountable stackable container according to claim 2, wherein the horizontal and vertical clamp elements comprise two sections, one section in the shape of a male type injected rectangular box having at its center and along it a "U" shaped channeled element presenting at its upper end, a lug for closing purposes, and the other section being a female type cap element coinciding with the channeled element through a groove to complete the clamp closure through simple pressure.

18. The mountable or demountable stackable container according to claim 2, wherein the semi-tubular peripheral profile further comprises in one of its belt folds, recessed sections at a 45° angle to form the container corners.

19. The mountable or demountable stackable container according to claim 2, wherein the container further comprises at each corner at the bottom, a plurality of small fin type injected projections accommodated in small stepped openings in the upper profile of the modules to allow stacking of the containers.

* * * * *